US011414619B2

(12) United States Patent
Plancq

(10) Patent No.: US 11,414,619 B2
(45) Date of Patent: Aug. 16, 2022

(54) GEAR LUBRICANT COMPOSITION

(71) Applicant: TOTAL MARKETING SERVICES, Puteaux (FR)

(72) Inventor: Louis Plancq, Levallois-Perret (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/761,605

(22) PCT Filed: Nov. 8, 2018

(86) PCT No.: PCT/FR2018/052780
§ 371 (c)(1),
(2) Date: May 5, 2020

(87) PCT Pub. No.: WO2019/092379
PCT Pub. Date: May 16, 2019

(65) Prior Publication Data

US 2020/0270544 A1 Aug. 27, 2020

(30) Foreign Application Priority Data

Nov. 9, 2017 (FR) ..... 1760558

(51) Int. Cl.

| | |
|---|---|
| ***C10M 105/04*** | (2006.01) |
| ***C10M 169/04*** | (2006.01) |
| ***C10M 101/02*** | (2006.01) |
| ***C10M 125/24*** | (2006.01) |
| ***C10M 129/10*** | (2006.01) |
| ***C10M 133/06*** | (2006.01) |
| ***C10M 133/44*** | (2006.01) |
| ***C10M 135/18*** | (2006.01) |
| ***C10M 135/36*** | (2006.01) |
| ***C10M 137/10*** | (2006.01) |
| ***C10M 139/04*** | (2006.01) |
| ***C10M 141/10*** | (2006.01) |
| *C10N 20/00* | (2006.01) |
| *C10N 30/00* | (2006.01) |
| *C10N 30/06* | (2006.01) |
| *C10N 30/10* | (2006.01) |
| *C10N 30/12* | (2006.01) |
| *C10N 30/14* | (2006.01) |
| *C10N 30/18* | (2006.01) |
| *C10N 40/04* | (2006.01) |

(52) U.S. Cl.

CPC ..... *C10M 169/04* (2013.01); *C10M 101/025* (2013.01); *C10M 125/24* (2013.01); *C10M 129/10* (2013.01); *C10M 133/06* (2013.01); *C10M 133/44* (2013.01); *C10M 135/18* (2013.01); *C10M 135/36* (2013.01); *C10M 137/10* (2013.01); *C10M 139/04* (2013.01); *C10M 141/10* (2013.01); *C10M 2201/084* (2013.01); *C10M 2201/085* (2013.01); *C10M 2203/1006* (2013.01); *C10M 2203/1045* (2013.01); *C10M 2203/1065* (2013.01); *C10M 2207/023* (2013.01); *C10M 2215/04* (2013.01); *C10M 2215/08* (2013.01); *C10M 2215/30* (2013.01); *C10M 2219/066* (2013.01); *C10M 2219/106* (2013.01); *C10M 2223/047* (2013.01); *C10M 2227/04* (2013.01); *C10N 2020/015* (2020.05); *C10N 2020/081* (2020.05); *C10N 2030/06* (2013.01); *C10N 2030/10* (2013.01); *C10N 2030/12* (2013.01); *C10N 2030/14* (2013.01); *C10N 2030/18* (2013.01); *C10N 2030/45* (2020.05); *C10N 2040/04* (2013.01)

(58) Field of Classification Search

CPC ..... C10M 105/04; C10M 2203/0206; C10N 2020/071; C10N 2030/64; C10N 2040/04
USPC ..... 585/240
See application file for complete search history.

(56) References Cited

U.S. PATENT DOCUMENTS

| | | | | |
|---|---|---|---|---|
| 6,475,960 | B1 * | 11/2002 | Berlowitz | C10M 111/04 508/110 |
| 8,022,258 | B2 * | 9/2011 | Myllyoja | C07C 5/2775 585/240 |
| 10,435,634 | B2 * | 10/2019 | Germanaud | C10G 45/02 |
| 11,021,669 | B2 * | 6/2021 | China | B60K 11/02 |
| 2005/0096236 | A1 | 5/2005 | Le Sausse et al. | |
| 2007/0135663 | A1 | 6/2007 | Aalto et al. | |
| 2009/0014354 | A1 * | 1/2009 | Knuuttila | C10G 29/24 208/58 |
| 2009/0062162 | A1 * | 3/2009 | Hee | C10M 111/04 508/110 |

(Continued)

FOREIGN PATENT DOCUMENTS

| | | | |
|---|---|---|---|
| CN | 105907449 | A | 8/2016 |
| CN | 106833839 | A | 6/2017 |

(Continued)

OTHER PUBLICATIONS

International Search Report, issued in PCT/FR2018/052780, dated Aug. 2, 2019.

*Primary Examiner* — Ellen M McAvoy
(74) *Attorney, Agent, or Firm* — Birch, Stewart, Kolasch & Birch, LLP

(57) ABSTRACT

A gear lubricant composition includes at least 97% by weight, based on the total weight of the lubricant composition, of at least one hydrocarbon-based oil that includes a weight content of isoparaffins ranging from 90 to 0%, a weight content of normal paraffins ranging from 0 to 10% and a carbon content of biological origin greater than or equal to 90% relative to the total weight of the oil, at least 0.01% by weight, based on the total weight of the lubricant composition, of at least one additive selected among the anti-wear additives, extreme pressure additives, anti-corrosion additives, additives having metal-deactivating properties, anti-foam additives, anti-oxidant additives selected among the phenolic anti-oxidants, and the mixtures thereof.

17 Claims, No Drawings

(56) References Cited

U.S. PATENT DOCUMENTS

| | | | | |
|---|---|---|---|---|
| 2009/0062163 | A1* | 3/2009 | Haire | C10M 111/04 508/110 |
| 2009/0062164 | A1* | 3/2009 | Hee | C10M 107/02 508/110 |
| 2009/0287029 | A1* | 11/2009 | Anumakonda | C10G 3/42 585/16 |
| 2011/0105812 | A1* | 5/2011 | Marker | C10L 1/08 585/14 |
| 2012/0053098 | A1 | 3/2012 | Okada et al. | |
| 2013/0012745 | A1* | 1/2013 | Knuuttila | B01J 23/74 585/240 |
| 2013/0345103 | A1* | 12/2013 | Nakao | C10M 169/04 508/372 |
| 2014/0303057 | A1* | 10/2014 | Abhari | A01N 25/02 508/589 |
| 2016/0230109 | A1* | 8/2016 | Wiersma | C10L 1/04 |
| 2017/0009144 | A1 | 1/2017 | Aalto et al. | |
| 2017/0121630 | A1 | 5/2017 | Vettel et al. | |
| 2017/0130161 | A1 | 5/2017 | Vettel et al. | |
| 2019/0264121 | A1* | 8/2019 | China | C10M 101/02 |

FOREIGN PATENT DOCUMENTS

| | | | |
|---|---|---|---|
| EP | 1 728 844 | A1 | 12/2006 |
| EP | 2 084 245 | A1 | 8/2009 |
| EP | 2 368 967 | A1 | 9/2011 |
| EP | 3 095 838 | A1 | 11/2016 |
| WO | WO 2008/058664 | A1 | 5/2008 |
| WO | WO 2008/152200 | A1 | 12/2008 |
| WO | WO 2014/033762 | A1 | 3/2014 |
| WO | WO 2016/185046 | A1 | 11/2016 |

* cited by examiner

GEAR LUBRICANT COMPOSITION

FIELD OF THE INVENTION

The present invention concerns the use of a composition as gear lubricant. Said lubricant compositions are classified as biodegradable, do not cause bioaccumulation in organisms and are not toxic for the environment, more particularly the aquatic environment.

The present invention also concerns gear lubricant compositions.

TECHNICAL BACKGROUND OF THE INVENTION

Since December 2013, American regulations have been amended and in particular require all shipping navigating in American waters to use EAL products (Environmental Acceptable Lubricants), and since 1992 in Europe an Ecolabel allows the identification among lubricants of those products which pay heed to the environment. The components of these products can be on the LuSC list (Lubricant Substance classification) and in particular are able to meet the strict requirements of biodegradability, bioaccumulation and aquatic toxicity. Ecolabel lubricants are considered to be lubricants which meet the environmental specifications of EAL lubricants.

These Ecolabel or EAL lubricants are used in equipment which may have interfaces and/or contacts with a user, with air and/or with water. This is particularly the case for gear lubricant compositions which can come into direct contact with water and/or air and/or with a person and/or become engaged in other any contact requiring biodegradable, non-toxic products.

Document US 2007/0135663 describes a base oil comprising at least 90 weight % of branched, saturated hydrocarbons of paraffinic or naphthenic type.

Document WO2008/152200 describes a method for producing branched, saturated hydrocarbons from feedstock of biological origin.

Document US 2017/0009144 describes a composition comprising 40-50 weight % of C14 paraffins and 35-45 weight % of C15 paraffins.

These three documents US 2007/0135663, WO2008/152200 and US 2017/0009144 disclose neither the use of the base oil as gear lubricant nor the additives as defined in the present invention.

Document US 2017/0121630 discloses a hydraulic fluid comprising a base oil obtained from terpenes. The base oil described in this document is obtained from partial hydrogenation of terpenes and also comprises alpha-olefins. This document does not therefore disclose a hydrocarbon oil comprising at least 90 weight % of isoparaffins.

Also, gear lubricant compositions for industrial or marine use must meet highly specific specifications in terms of performance, in particular in terms of oxidation stability.

There is therefore an advantage in providing biodegradable-classified lubricant compositions which meet all the specific tests for gear lubricant compositions.

It is one objective of the present invention to provide a lubricant composition having improved oxidation stability.

SUMMARY OF THE INVENTION

These objectives are reached with a novel gear lubricant composition.

The invention concerns the use of a composition as gear lubricant, said composition comprising

- at least 97 weight %, relative to the total weight of the lubricant composition, of at least one hydrocarbon oil having a weight content of isoparaffins in the range of from 90 to 100%, a weight content of normal paraffins in the range of from 0 to 10% and a carbon content of biological origin equal to or higher than 90% relative to the total weight of the hydrocarbon oil; and
- at least 0.01 weight %, relative to the total weight of the lubricant composition, of at least one additive selected from among anti-wear additives, extreme-pressure additives, anticorrosion additives, metal-deactivators, anti-foam additives, antioxidant additives selected from among phenolic antioxidants, and mixtures thereof.

In one embodiment the composition comprises:

- from 97 to 99.95 weight %, preferably 97.5 to 99.9 weight %, more preferably from 98 to 99.5 weight % of hydrocarbon oil, relative to the total weight of the lubricant composition; and
- from 0.5 to 3 weight %, preferably 0.1 to 2.5 weight % more preferably 0.5 to 2 weight %, relative to the total weight of the lubricant composition, of at least one additive selected from among anti-wear additives, extreme-pressure additives, anticorrosion additives, metal-deactivators, anti-foam additives, antioxidants, and mixtures thereof.

In one embodiment of the invention the anti-wear additives are selected from among triaryl phosphates, carbamates and thiocarbamates, and/or the extreme-pressure additives are selected from among ashless phosphorus or sulfur-phosphorus additives such as phosphates, phosphorothionates, phosphonates, dithiophosphates and thiophosphates such as dialkyl dithiophosphates, and/or the anticorrosion additives are selected from among N-acyl sarcosine compounds and/or the metal-deactivators are selected from among tolutriazole, derivatives of tolutriazole or dimercaptothiadiazoles and/or the anti-foam additives are selected from among silicone compounds, and/or the antioxidant additives are selected from among phenolic antioxidant additives, and mixtures thereof.

In one embodiment of the invention said at least one additive is a phenolic antioxidant, preferably selected from among compounds comprising a phenol group in which at least one vicinal carbon of the carbon carrying the alcohol function is substituted by at least one $C_1$-$C_{10}$ alkyl group, preferably a $C_1$-$C_6$ alkyl group, preferably a $C_4$ alkyl group, preferably by the tert-butyl group.

In one embodiment, the composition comprises at least 0.01 weight %, relative to the total weight of the composition, of at least one additive selected from among:

- anti-wear additives selected from among triaryl thiophosphates, carbamates and thiocarbamates;
- extreme-pressure additives selected from among ashless phosphorus or sulfur-phosphorus additives such as phosphates, phosphorothionates, phosphonates, dithiophosphates and thiophosphates such as dialkyl dithiophosphates;
- metal-deactivators selected from among tolutriazole, derivatives of tolutriazole or dimercaptothiadiazoles;
- and mixtures thereof.

In one embodiment of the invention, the hydrocarbon oil is selected from among non-cyclic isoparaffins having 14 to 18 carbon atoms.

In one embodiment of the invention the hydrocarbon oil comprises:

- a weight content of isoparaffins in the range of 90 to 100%, preferably 95 to 100% and more preferably 98 to 100% relative to the total weight of the hydrocarbon oil; and/or
- a carbon content of biological origin equal to or higher than 95%, preferably equal to or higher than 98%, and more preferably 100%; and/or
- a weight content of normal paraffins equal to or lower than 10%, preferably equal to or lower than 5%, more preferably equal to or lower than 2% relative to the total weight of the hydrocarbon oil; and/or
- a weight content of naphthenic compounds equal to or lower than 1%, preferably equal to or lower than 0.5% and more preferably equal to or lower than 100 ppm relative to the total weight of the hydrocarbon oil; and/or
- a weight content of aromatic compounds equal to or lower than 500 ppm, preferably equal to or lower than 300 ppm, more preferably equal to or lower than 100 ppm, further preferably equal to or lower than 50 ppm and advantageously equal to or lower than 20 ppm, relative to the total weight of the hydrocarbon oil.

In one embodiment of the invention, the hydrocarbon oil has:

- a distillation range ranging from 230 to 340° C., preferably 235 to 330° C. and more preferably 240 to 325° C., further preferably 290° C. to 325° C. measured in accordance with standard ASTM D86; and/or
- biodegradability at 28 days of at least 60%, preferably at least 70%, more preferably at least 75% and further preferably at least 80% measured in accordance with standard OECD 306; and/or
- a flash point equal to or higher than 110° C. in accordance with EN ISO 2719; and/or
- kinematic viscosity at 40° C. equal to or less than cSt, preferably equal to or less than 4.5 cSt and more preferably equal to or less than 4 cSt.

In one embodiment of the invention the hydrocarbon oil has a distillation range of from 290° C. to 325° C. measured in accordance with standard ASTM D86 and kinematic viscosity equal to or less than 5 cSt.

In one embodiment of the invention, the hydrocarbon oil is obtained by a catalytic hydrogenation process, at a temperature of 80 to 180° C. and pressure of 50 to 160 bar, of a deoxygenated and/or isomerized feedstock of biological origin.

In one embodiment of the invention the composition comprises:

- from 97 to 99.9 weight %, relative to the total weight of the lubricant composition, of a hydrocarbon oil comprising at least 98 weight % of isoparaffins, less than 2 weight % of normal paraffins and a carbon content of biological origin equal to or higher than 90% relative to the total weight of the hydrocarbon oil, said hydrocarbon oil having kinematic viscosity at 40° C. equal to or less than 5 cSt;
- from 0.1 to 3 weight %, relative to the total weight of the lubricant composition, of at least one additive selected from among:
  - anti-wear additives selected from among triaryl thiophosphates, carbamates and thiocarbamates;
  - extreme-pressure additives selected from among ashless phosphorus or sulfur-phosphorus additives such as phosphates, phosphorothionates, phosphonates, dithiophosphates and thiophosphates such as dialkyl dithiophosphates;
  - metal-deactivators selected from among tolutriazole, derivatives of tolutriazole or dimercaptothiadiazoles
  - antioxidants selected from among phenolic antioxidants;
  - and mixtures thereof.

In one embodiment, the temperature of use of the composition is in the range of 50 to 400° C., preferably 100 to 300° C.

The present invention also concerns a gear lubricant composition comprising:

- at least 97 weight %, relative to the total weight of the lubricant composition, of a hydrocarbon oil comprising a weight content of isoparaffins in the range of 90 to 100%, a weight content of normal paraffins in the range of 0 to 10% and a carbon content of biological origin equal to or higher than 90% relative to the total weight of the hydrocarbon oil; and
- at least 0.01 weight %, relative to the total weight of the lubricant composition, of at least one additive selected from among anti-wear additives, extreme-pressure additives anticorrosion additives, metal-deactivators, anti-foam additives, phenolic antioxidant additives, and mixtures thereof, with the proviso that if said additive is a phenolic antioxidant, then said phenolic antioxidant is contained in an amount of at least 0.015 weight % relative to the total weight of the lubricant composition.

In one embodiment of the invention, the lubricant composition comprises at least 0.1 weight %, relative to the total weight of the lubricant composition, of at least one additive selected from among anti-wear additives, extreme-pressure additives, anticorrosion additives, metal-deactivators, anti-foam additives, phenolic antioxidant additives, and mixtures thereof.

In one embodiment of the invention the additive of the lubricant composition is such as defined with regard to the use of the invention and/or the hydrocarbon oil is such as defined with regard to the use of the invention.

The lubricant composition of the invention allows providing a composition that is classified as non-irritant and biodegradable.

The lubricant composition of the invention particularly allows gear lubricant compositions to be obtained that are particularly efficient.

The lubricant composition of the invention affords improved oxidation stability compared with gear compositions currently in use. The lubricant composition of the invention can therefore contain a reduced amount of antioxidant additives, even not any antioxidant additives.

DETAILED DESCRIPTION OF THE INVENTION

The invention first concerns the use of a composition as gear lubricant, said composition comprising:

- at least 97 weight % of a least one hydrocarbon oil comprising a weight content of isoparaffins in the range of from 90 to 100%, a weight content of normal paraffins in the range of from 0 to 10% and a carbon content of biological origin equal to or higher than 90% relative to the total weight of the hydrocarbon oil; and
- at least 0.01 weight % of at least one additive selected from among anti-wear additives, extreme-pressure additives, anticorrosion additives, metal-deactivators, anti-foam additives, antioxidants and mixtures thereof, relative to the total weight of the lubricant composition.

As a preliminary, it will be noted that in the following description and claims, the expression "comprised between" is to be construed as including the cited limits.

Lubricant Composition:

In one embodiment of the invention, the lubricant composition comprises:

from 97 to 99.99 weight %, preferably 97 to 99.95 weight %, more preferably 97.5 to 99.9 weight %, further preferably 98 to 99.5 weight % of hydrocarbon oil relative to the total weight of the lubricant composition; and from 0.01 to 3 weight %, preferably 0.05 to 3 weight %, more preferably 0.1 to 2.5 weight %, further preferably 0.5 to 2 weight %, relative to the total weight of the lubricant composition, of at least one additive selected from among anti-wear additives, extreme-pressure additives, anticorrosion additives, metal-deactivators, anti-foam additives, antioxidants selected from among phenolic antioxidants, and mixtures thereof.

In one embodiment of the invention the lubricant composition is essentially composed of:

from 97 to 99.99 weight %, preferably 97 to 99.95 weight %, more preferably 97.5 to 99.9 weight %, further preferably 98 to 99.5 weight % of hydrocarbon oil relative to the total weight of the lubricant composition; and from 0.01 to 3 weight %, preferably 0.05 to 3 weight %, more preferably 0.1 to 2.5 weight %, further preferably 0.5 to 2 weight %, relative to the total weight of the lubricant composition, of at least one additive selected from among anti-wear additives, extreme-pressure additives, anticorrosion additives, metal-deactivators, anti-foam additives, antioxidants selected from among phenolic antioxidants, and mixtures thereof.

Preferably, the lubricant composition meets the criteria of Regulation (EC) N° 66/2010 of the European Parliament and Council of 25 Nov. 2009. This Regulation allows establishment of the European Union Ecolabel. The reference system for certification of the EU Ecolabel for Lubricants (Identification N° EC 511 revision 4 of 4 July 2016) details the criteria for Lubricants. The substances and mixtures subject of limitation or exclusion are defined in this reference system. Additional requirements in terms of aquatic toxicity are specified (methods OECD 201 for algae, OECD 202 for daphnia, OECD 203 for fish). The criteria for biodegradability and potential bioaccumulation are defined in this same reference system.

Hydrocarbon Oil

The lubricant composition used in the present invention has a hydrocarbon oil content equal to or higher than 97 weight %, preferably in the range of 97 to 99.95 weight %, more preferably 97.5 to 99.9 weight %, further preferably 98 to 99.5 weight % relative to the total weight of the composition.

The hydrocarbon oil of the lubricant composition used in the invention preferably has a weight content of isoparaffinic compounds equal to or higher than 90%, more preferably equal to or higher than 95% and advantageously equal to or higher than 98% relative to the total weight of the hydrocarbon oil.

In one embodiment, the isoparaffinic compounds contained in the hydrocarbon oil used in the invention have 12 to 30 carbon atoms, preferably 13 to 19 carbon atoms, more preferably 14 to 18 carbon atoms.

In one embodiment of the invention the isoparaffinic compounds contained in the hydrocarbon oil used in the invention have a molar mass in the range of from 170 to 285 g/mol, preferably in the range of from 180 to 270 g/mol, and more preferably in the range of from 195 to 260 g/mol.

The hydrocarbon oil of the lubricant composition used in the invention preferably has a weight content of normal paraffins equal to or lower than 10%, preferably equal to or lower than 5%, and advantageously equal to or lower than 2%.

The hydrocarbon oil of the lubricant composition of the invention advantageously comprises a majority amount of isoparaffins and a minority amount of normal paraffins. These isoparaffins are advantageously non-cyclic isoparaffins. Preferably, the hydrocarbon oil of the lubricant composition has a weight ratio of isoparaffins to normal paraffins of at least 12:1, preferably at least 15.1 and more preferably at least 20:1. Still further advantageously, the hydrocarbon oil of the lubricant composition used in the invention does not contain any normal paraffins.

In one embodiment, the hydrocarbon oil used in the invention preferably has a weight content of isoparaffins in the range of 90 to 100% and weight content of normal paraffins in the range of 0 to 10%, preferably 95 to 100% isoparaffins and 0 to 5% of normal paraffins and more preferably 98 to 100% of isoparaffins and 0 to 2% of normal paraffins.

In one embodiment, the hydrocarbon oil of the lubricant composition used in the invention preferably has a weight content of isoparaffins in the range of 90 to 100% and a content of normal paraffins in the range of 0 to 10%, more preferably 95 to 100% of isoparaffins selected from among alkanes having 12 to 30 carbon atoms, preferably 13 to 19 carbon atoms, more preferably 14 to 18 carbon atoms.

In one embodiment, the hydrocarbon oil used in the invention comprises:

isoparaffins having 15 carbon atoms and isoparaffins having 16 carbon atoms in a combined amount ranging from 80 to 98 weight % relative to the total weight of the hydrocarbon oil; or isoparaffins having 16 carbon atoms, isoparaffins having 17 carbon atoms and isoparaffins having 18 carbon atoms in a combined amount ranging from 80 to 98 weight % relative to the total weight of the hydrocarbon oil; or isoparaffins having 17 carbon atoms and isoparaffins having 18 carbon atoms in a combined amount ranging from 80 to 98 weight % relative to the total weight of the hydrocarbon oil.

In one preferred embodiment of the invention the hydrocarbon oil used in the lubricant composition comprises isoparaffins having 17 carbon atoms and isoparaffins having 18 carbon atoms in a combined amount ranging from 80 to 98 weight % relative to the total weight of the hydrocarbon oil.

The hydrocarbon oil of the lubricant composition of the invention preferably has a weight content of naphthenic compounds equal to or less than 3%, preferably equal to or less than 1%, more preferably equal to or less than 0.5% and further preferably equal to or less than 100 ppm.

In another preferred embodiment, the hydrocarbon oil of the lubricant composition used in the invention has a weight content of isoparaffins in the range of 90 to 100%, a weight content of normal paraffins in the range of 0 to 10% and a weight content of naphthenes equal to or less than 1%. Preferably, the hydrocarbon oil has a weight content of isoparaffins in the range of 95 to 100%, from 0 to 5% of normal paraffins and a weight content of naphthenes equal to or less than 0.5%. More preferably it has a weight content of isoparaffins in the range of 98 to 100%, from 0 to 2% of normal paraffins and a weight content of naphthenes equal to or less than 100 ppm.

The hydrocarbon oil used in the lubricant composition of the invention is advantageously free of aromatic compounds. By "free" it is meant a weight content of aromatic compounds equal to or less than 500 ppm, preferably equal to or less than 300 ppm, more preferably equal to or less than 100 ppm, further preferably equal to or less than 50 ppm and advantageously equal to or less than 20 ppm, measured via UV spectrometry for example.

The weight content of isoparaffins, normal paraffins, naphthenes and/or aromatics of the hydrocarbon oil can be determined using methods well-known to persons skilled in the art. For example, nonlimiting mention can be made of gas phase chromatography.

In another preferred embodiment, the hydrocarbon oil of the lubricant composition has a weight content of isoparaffins in the range of 90 to 100%, a weight content of normal paraffins in the range of 0 to 10%, a weight content of naphthenes equal to or lower than 1% and a weight content of aromatic compounds equal to or less than 500 ppm. Preferably, the hydrocarbon oil has a weight content of isoparaffins ranging from 95 to 100%, 0 to 5% of normal paraffins, a weight content of naphthenes equal to or lower than 0.5% and a weight content of aromatic compounds equal to or less than 300 ppm, preferably less than 100 ppm, more preferably less than 50 ppm and advantageously less than 20 ppm. Preferably also, the hydrocarbon oil has a weight content in the range of 95 to 100% of isoparaffins, 0 to 5% of normal paraffins and a weight content of aromatic compounds equal to or less than 100 ppm. More preferably, it has a weight content of isoparaffins in the range of 98 to 100% and 0 to 2% of normal paraffins, a weight content of naphthenes equal to or less than 100 ppm and a weight content of aromatic compounds equal to or less than 100 ppm.

The hydrocarbon oil used in the lubricant composition of the invention also preferably has an extremely low weight content of sulfur compounds, typically equal to or less than 5 ppm, preferably equal to or less than 3 ppm, and more preferably equal to less than 0.5 ppm, at a level that is too low for detection by conventional low sulfur content analysers.

The hydrocarbon oil used in the lubricant composition of the invention also preferably has a flash point equal to or higher than 110° C., preferably equal to or higher than 120° C. and more preferably equal to or higher than 140° C. in accordance with standard EN ISO 2719. A high flash point, typically higher than 110° C., inter alia allows the overcoming of safety issues during storage and transport since the hydrocarbon oil will be less flammable.

The hydrocarbon oil also preferably has a vapour pressure at 20° C. equal to or lower than 0.01 kPa.

In one embodiment, the hydrocarbon oil used in the lubricant also preferably has a flash point equal to or higher than 110° C. in accordance with standard EN ISO 2719 and a vapour pressure at 20° C. equal to or lower than 0.01 kPa. Preferably, the hydrocarbon oil has a flash point equal to or higher than 120° C. and a vapour pressure at 20° C. equal to or lower than 0.01 kPa. More preferably, it has a flash point equal to or higher than 140° C. and a vapour pressure at 20° C. equal to or lower than 0.01 kPa.

The hydrocarbon oil used in the lubricant composition of the invention has boiling temperatures, a flash point and a vapour pressure allowing problems of flammability, odour and volatility to be overcome.

The hydrocarbon oil of the lubricant composition of the invention also preferably has a kinematic viscosity at 40° C. equal to or less than 5 cSt, preferably equal to or less than 4.5 cSt and more preferably equal to or less than 4 cSt in accordance with standard EN ISO 3104.

Method for Obtaining the Hydrocarbon Oil:

Said hydrocarbon oil compositions can be obtained in the following manner. The hydrocarbon oil of the invention is a hydrocarbon fraction derived from the conversion of biomass.

By derived from conversion of biomass it is meant a hydrocarbon fraction produced from raw materials of biological origin.

Preferably, the hydrocarbon fraction of biological origin is obtained by a process comprising steps of hydrodeoxygenation (HDO) and isomerization (ISO). The hydrodeoxygenation step (HDO) leads to decomposition of the structures of biological esters or triglyceride constituents, to removal of oxygenated, phosphorus- and sulfur-containing compounds, and to hydrogenation of olefinic bonds. The product derived from the hydrodeoxygenation reaction is isomerized. A fractionating step can preferably follow after the hydrodeoxygenation and isomerization steps. Advantageously, the fractions of interest are then subjected to hydrotreatment and distillation steps to obtain the desired specifications of the hydrocarbon oil of the invention.

This HDO/ISO process is implemented on raw biological feedstock, also called biomass or raw material of biological origin, selected from the group formed by vegetable oils, animal fats, fish oils and mixtures thereof. Suitable raw materials of biological origin are for example rapeseed oil, canola oil, tall oil, sunflower seed oil, soybean oil, hemp oil, olive oil, flax oil, mustard oil, palm oil, groundnut oil, castor oil, coconut oil, animal fats such as tallow, recycled food fats, raw materials derived from genetic engineering, and biological raw materials produced from microorganisms such as algae and bacteria. Condensation products, esters or other derivatives obtained from raw biological materials can also be used as raw materials.

Preferably, the raw material of biological origin is an ester or triglyceride derivative. This material is first subjected to a hydrodeoxygenation step (HDO) to decompose the structure of the constituent esters or triglycerides and to remove oxygenated, phosphorus- and sulfur-containing compounds concomitantly with hydrogenation of the olefinic bonds. This hydrodeoxygenation step (HDO) of the raw material of biological origin is followed by isomerization of the product obtained, leading to branching of the hydrocarbon chain and to improved properties of paraffin at low temperature.

At the HDO step, hydrogen and the raw material of biological origin are passed over a hydrodeoxygenation catalytic bed simultaneously, in the same direction or in counter-current. At the HDO step, the pressure and temperature are respectively between 20 and 150 bar and between 200 and 500° C. Known, conventional hydrodeoxygenation catalysts are used for this step. Optionally, the raw material of biological origin, before the HDO step, can be subjected to pre-hydrogenation under mild conditions to prevent secondary reactions of double bonds.

The product resulting from the hydrodeoxygenation reaction is subjected to an isomerization step (ISO) at which hydrogen and said product, and optionally a mixture of n-paraffins, are passed over isomerization catalytic beds simultaneously, in the same direction or in counter current. At the ISO step, the pressure and temperature are respectively between 20 and 150 bar and between 200 and 500° C. Known, conventional isomerization catalysts are used at this step.

Additionally, secondary processes can also be applied (e.g. intermediate mixing, scavenging or the like).

The product resulting from the HDO/ISO steps can optionally be fractionated to obtain the fractions of interest.

Various HDO/ISO processes are described in the literature. Application WO 2014/033762 describes a process comprising a pre-hydrogenation step, a hydrodeoxygenation step (HDO) and an isomerization step conducted in counter current flow. Patent application EP 1728844 describes a method for producing hydrocarbon compounds from a mixture of compounds of vegetable and animal origin. This method comprises a pre-treatment step of the mixture to remove contaminants, e.g. alkali metal salts, followed by a hydrodeoxygenation step (HDO) an isomerization step. Patent application EP 2084245 describes a method for producing a hydrocarbon mixture, which can be used as diesel oil or in a diesel oil composition, via hydrodeoxygenation of a mixture of biological origin containing fatty acid esters optionally in a mixture with free fatty acids, for example vegetable oils such as sunflower seed oil, rapeseed oil, canola oil, palm oil or pine oil, followed by hydroisomerization on specific catalysts. Patent application EP 2368967 describes said method and the product obtained with this method. Application WO 2016/185046 describes a method for obtaining a hydrocarbon oil used according to the invention wherein the hydrocarbon oil is obtained with a catalytic hydrogenation process at a temperature of 80 to 180° C. and at a pressure of 50 to 160 bar from deoxygenated and isomerized biological feedstock.

Advantageously, the raw material of biological origin contains less than 15 ppm of sulfur, preferably less than 8 ppm, more preferably less than 5 ppm and further preferably less than 1 ppm in accordance with standard EN ISO 20846. Ideally, the raw material of biosourced origin used as feedstock does not contain sulfur.

Before the hydrotreatment step, a pre-fractionating step can be performed. A narrower-cut fraction fed into the hydrogenation unit allows a narrow-cut fraction to be obtained on leaving the unit. The boiling points of pre-fractionated fractions are between 220 and 330° C. whilst fractions which have not been pre-fractionated typically have boiling points between 150 and 360° C.

The deoxygenated, isomerized feedstock derived from the HDO/ISO process is hydrogenated.

The hydrogen used in the hydrogenation unit is typically highly purified hydrogen. By highly purified hydrogen it is meant hydrogen having purity higher than 99% for example, even if other grades could also be used.

The hydrogenation step is conducted by means of catalysts. Standard hydrogenation catalysts can either be bulk or supported, and may comprise the following metals: nickel, platinum, palladium, rhenium, rhodium, nickel tungstate, nickel-molybdenum, molybdenum, cobalt-molybdenum. The supports can be silica, alumina, silica-alumina or zeolites.

One preferred catalyst is a nickel-based catalyst on an alumina support having a specific surface area which varies between 100 and 200 $m^2/g$ of catalyst, or a bulk nickel catalyst. Conditions for hydrogenation are typically the following:

- Pressure: 50 to 160 bar, preferably 80 to 150 bar and more preferably 90 to 120 bar;
- Temperature: 80 to 180° C., preferably 120 to 160° C. and more preferably 150 to 160° C.;
- Liquid Hourly space velocity (LHSV): 0.2 to 5 $hr^{-1}$, preferably 0.4 to 3 $hr^{-1}$ and more preferably 0.5 to 0.8 $hr^{-1}$;
- Hydrogen treatment rate: adapted to the above-mentioned conditions and possibly reaching 200 $Nm^3$/tonnes of feedstock to be treated.

The temperature in the reactors is typically between 150 and 160° C. with a pressure of about 100 bar, whilst the liquid hourly space velocity is about 0.6 $hr^{-1}$ with a treatment rate adapted as a function of the quality of the feedstock to be treated and the parameters of the first hydrogenation reactor.

Hydrogenation can also take place in one or more reactors in series. The reactors may comprise one or more catalytic beds. The catalytic beds are generally fixed catalytic beds.

The hydrogenation process is preferably carried out in two or three reactors, preferably in three reactors and more preferably in three reactors in series.

The first reactor is used for scavenging of sulfur-containing compounds and hydrogenation of essentially all unsaturated compounds and up to about 90% of aromatic compounds. The product leaving the first reactor contains substantially no sulfur-containing compound. At the second stage i.e. in the second reactor hydrogen of the aromatics is continued and up to 99% of aromatics are thereby hydrogenated.

The third stage in the third reactor is a finishing stage allowing contents of aromatics to be obtained of 500 ppm or less, preferably 300 ppm or less, more preferably 100 ppm or less and further preferably 50 ppm or less, and ideally equal to or less than 20 ppm, even for products with high boiling point e.g. higher than 300° C.

It is possible to use a reactor comprising two, three or more catalytic beds. The catalysts can be in variable amounts possibly being different or essentially the same in each reactor; for three reactors, the amounts as a function of weight can be 0.05-0.5/0.10-0.70/0.25-0.85 for example, preferably 0.07-0.25/0.15-0.35/0.4-0.78 and more preferably 0.10-0.20/0.20-0.32/0.48-0.70.

It is also possible to use one or two hydrogenation reactors instead of three.

It is also possible that the first reactor is composed of twin reactors used alternately. This operating mode particularly allows facilitated loading and unloading of catalysts: when the first reactor comprises the catalyst that is first saturated (substantially all the sulfur is trapped on and/in the catalyst), this catalyst must be changed often.

A single reactor can also be used in which two, three or more catalytic beds are installed.

It may be necessary to insert quench boxes (to stifle the reaction) in the recycle system or between the reactors to cool the effluents from one reactor to another or from one catalytic bed to another, to control the temperatures and hydrothermal balance of each reaction. In one preferred embodiment, there are no cooling or quenching intermediates.

In one embodiment, the product resulting from the process and/or the separated gas(s) are at least partly recycled back into the feed system of the hydrogenation reactors. This dilution contributes towards maintaining the exothermicity of the reaction within controlled limits, in particular at the first stage. In addition, recycling allows heat exchange before the reaction and additionally better control over temperature.

The effluent from the hydrogenation unit chiefly contains the hydrogenated product and hydrogen. Flash separators are used to separate the effluents into a gas phase, mainly residual hydrogen, and a liquid phase mainly hydrogenated hydrocarbon fractions. This process can be carried out using three flash separators, one at high pressure, one at intermediate pressure and one at low pressure very close to atmospheric pressure.

The gaseous hydrogen collected data the top of the flash separators can be recycled back to the feed system of the hydrogenation unit, or to different stages in the hydrogenation units between the reactors.

In one embodiment, the end product is separated at atmospheric pressure. It is then fed directly into a vacuum fractionating unit. Preferably, fractionation is performed at a pressure of between 10 and 50 bar, and more preferably at about 30 bar.

Fractionation can be performed so that it is possible simultaneously to withdraw various hydrocarbon fluids from the fractionating column, and so that their boiling point is able to be predetermined.

By adapting the feedstock via the initial and final boiling points thereof, the hydrogenation reactors, separators and fractionating unit can therefore be directly connected without the need for intermediate vessels. This continuity between hydrogenation and fractionation allows optimised thermal integration associated with a reduction in the number items of equipment together with energy savings.

The hydrocarbon oil used in the lubricant composition of the invention is advantageously a hydrocarbon fraction having a distillation range DR (in ° C.) in the range of 230° C. to 340° C., preferably 235° C. to 330° C. and more preferably 240° C. to 325° C., further preferably 290 to 325° C., measured in accordance with standard ASTM D86. Preferably, the difference between the final boiling point and initial boiling point is equal to or less than 80° C., preferably equal to or less than 70° C., more preferably equal to or less than 60° C. and advantageously it is between 40 and 50° C. The hydrocarbon oil may comprise one or more fractions having distillation ranges lying within the above ranges.

Advantageously, the hydrocarbon oil used in the lubricant composition of the invention is fully saturated. Preferably, the components of the hydrocarbon oil are selected from among isoparaffins having 12 to 30 carbon atoms, preferably 13 to 19 carbon atoms, and more preferably 14 to 18 carbon atoms.

The lubricant composition of the invention advantageously has a weight content of isohexadecane equal to or less than 50%.

The hydrocarbon oil of the lubricant composition of the invention is ideally derived from treatment of raw materials of biological origin. The carbon of a biomaterial results from photosynthesis of plants and hence from atmospheric $CO_2$. Degradation (by degradation it is also meant end-of-life combustion/incineration) of these materials to $CO_2$ does not therefore contribute towards global warming since there is no increase in carbon emitted in the atmosphere. The $CO_2$ balance of biomaterials is therefore distinctly better and contributes towards reducing the carbon footprint of the products obtained (solely the energy required for manufacture must be taken into account). On the contrary, a material of fossil origin that has degraded to $CO_2$ will contribute towards increasing $CO_2$ levels and hence to global warming. The hydrocarbon oil used in the invention will therefore have a better carbon footprint than that of compounds obtained from a fossil source.

The term «bio-carbon» indicates that the carbon is of natural origin and is derived from a biomaterial as indicated below. Bio-carbon content and biomaterial content are expressions indicating the same value. A renewable material or biomaterial is an organic material in which the carbon is derived from recently fixed $CO_2$ (on human scale) via photosynthesis with the atmosphere. A biomaterial (Carbone 100% of natural origin) has a $^{14}C/^{12}C$ isotopic ratio greater than $10^{-12}$, typically about $1.2\times10^{-12}$, whilst a fossil material has a zero ratio. Isotopic $^{14}C$ is formed in the atmosphere and is therefore integrated via photosynthesis on a time scale of no more than a few tens of years. The half-life of $^{14}C$ is 5730 years. As a result, materials derived from photosynthesis, namely plants in general, necessarily have a maximum content of isotope $^{14}C$.

Determination of the content of biomaterial or bio-carbon is given in accordance with standards ASTM D 6866-12, method B (ASTM D 6866-06) and ASTM D 7026 (ASTM D 7026-04). Standard ASTM D 6866 concerns «Determining the Biobased Content of Natural Range Materials Using Radiocarbon and Isotope Ratio Mass Spectrometry Analysis», whilst standard ASTM D 7026 concerns «Sampling and Reporting of Results for Determination of Biobased Content of Materials via Carbon Isotope Analysis». The second standard mentions the first in the first paragraph thereof.

The first standard describes a test to measure the $^{14}C/^{12}C$ ratio of a sample and comparison with the $^{14}C/^{12}C$ ratio of a reference sample of 100% renewable origin, to give a relative percentage of C of renewable origin in the sample. The standard is based on the same concept as $^{14}C$ dating, but without applying dating equations. The ratio thus calculated is indicated as «pMC» (percent Modern Carbon). If the material to be analysed is a mixture of biomaterials and fossil materials (without radioactive isotope), the pMC value obtained is directly correlated with the quantity of biomaterial contained in the sample. The reference value used for $^{14}C$ dating is a value dating from the 1950s. The year 1950 was chosen on account of the existence of nuclear testing in the atmosphere which sent large amounts of isotopes into the atmosphere after this date. The 1950 reference corresponds to a pMC value of 100. Having regard to thermonuclear tests, the current value to be retained is about 107.5 (which corresponds to a correction factor of 0.93). The radiocarbon signature of a plant today is therefore 107.5. A signature of 54 pMC and 99 pMC therefore corresponds to a quantity of biomaterial in the sample of 50% and 93% respectively.

The hydrocarbon oil of the lubricant composition of the invention has biomaterial content of at least 90%. This content is advantageously higher, in particular equal to or higher than 95%, preferably equal to or higher than 98% and advantageously it is 100%.

In one embodiment, the $^{14}C/^{12}C$ isotopic ratio of the hydrocarbon oil used in the invention is between 1.15 and $1.2\times10^{-12}$.

In addition to a particularly high biomaterial content, the hydrocarbon oil of the lubricant composition of the invention has particularly good biodegradability. Biodegradation of an organic chemical product refers to reduction of the complexity of the chemical compounds through the metabolic activity of microorganisms. Under aerobic conditions, microorganisms convert organic substances to carbon dioxide, water and biomass. The OECD 306 method is used to evaluate the biodegradability of individual substances in seawater. According to this method, the hydrocarbon oil has biodegradability at 28 days of at least 60%, preferably at least 70%, more preferably at least 75% and advantageously at least 80%.

The OECD 306 method is the following:

For the closed bottle method, a predetermined amount of the substance to be tested is dissolved in a test medium at a concentration conventionally of 2-10 mg/L, one or more concentrations being used. The solution is kept in a filled, closed bottle away from light at a constant temperature in the range of 15-20° C. Degradation is monitored via analysis of oxygen over a period of 28 days. 24 bottles are used (8 for the substance to be tested, 8 for the reference compound and 8 for nutrients). All analyses are performed on several bottles. At least 4 determinations of dissolved oxygen are carried out (Day 0, 5, 15 and 20) using a chemical or electrochemical method.

In one particular embodiment of the invention, the hydrocarbon oil comprises:

- a weight content of isoparaffins in the range of 95 to 100%, preferably 98% to 100%, relative to the total weight of the hydrocarbon oil; and
- a weight content of normal paraffins equal to or less than 5% and preferably equal to or less than 2%, relative to the total weight of the hydrocarbon oil; and
- a weight content of naphthenic compounds equal to or lower than 0.5% and preferably equal to or less than 100 ppm, relative to the total weight of the hydrocarbon oil; and
- a weight content of aromatic compounds equal to or less than 300 ppm, preferably equal to or less than 100 ppm, more preferably equal to or less than 50 ppm and advantageously equal to or less than 20 ppm, relative to the total weight of the hydrocarbon oil.

In one particular embodiment of the invention, the hydrocarbon oil comprises:

- a weight content of isoparaffins in the range of 98% to 100%, relative to the total weight of the hydrocarbon oil; and
- a kinematic viscosity at 40° C. equal to or less than 5 cSt, preferably equal to or less than 4.5 cSt and more preferably equal to or less than 4 cSt Additives:

The lubricant composition used in the invention comprises at least 0.01 weight %, preferably from 0.01 to 3%, more preferably 0.05 to 3 weight %, further preferably 0.1 to 2.5 weight %, still further preferably 0.5 to 2 weight % of additive(s) selected from among anti-wear additives, extreme-pressure additives, anticorrosion additives, metal-deactivators, anti-foam additives, antioxidants selected from among phenolic antioxidants, and mixtures thereof, relative to the total weight of the lubricant composition.

In the meaning of the present invention, the anti-wear additives, extreme-pressure additives, anticorrosion additives, metal-deactivators, anti-foam additives, antioxidants differ from the hydrocarbon oil defined above, more particularly said additives are compounds are distinct from the hydrocarbon oil e.g. through chemical type.

In one embodiment of the invention the additive(s) are selected from among anti-wear additives, extreme-pressure additives, anticorrosion additives, metal-deactivators, anti-foam additives and mixtures thereof, relative to the total weight of the lubricant composition.

Preferably the additives that can be used in the compositions of the invention are LuSC-list additives (Lubricant Substance Classification list) or additives allowing a biodegradable formula to be obtained meeting the Ecolabel standard or American EAL specifications.

Anti-wear additives and extreme-pressure additives protect surfaces against friction through the forming of a protective film adsorbed on these surfaces. There is a large variety of anti-wear additives. Preferably, some additives are both anti-wear and extreme-pressure additives.

Preferably, for the lubricant composition of the invention, the anti-wear and extreme-pressure additives are selected from among ashless phosphorus or sulfur-phosphorus additives such as phosphates, phosphorothionates, phosphonates, dithiophosphates and thiophosphates e.g. dialkyl dithiophosphates.

As anti-wear additive, mention can also be made of triaryl thiophosphates, carbamates and thiocarbamates.

Preferably also, some additives are both anti-wear, extreme-pressure and anticorrosion additives. Amongst these additives, mention can be made of amine phosphates which can be used in the lubricant composition of the invention.

Among anticorrosion additives which can be used in the lubricant composition of the invention, mention can be made of N-acyl sarcosine compounds.

Among metal-deactivators, mention can be made of tolutriazole, derivatives of tolutriazole or dimercaptothiadiazoles. The metal-deactivator particularly allows neutralisation of the catalytic effect of metals such as copper and iron.

By «derivative of tolutriazole» it is meant a tolutriazole compound substituted preferably by one of more alkyl groups optionally comprising one or more heteroatoms.

Among the anti-foam additives that can be used in the lubricant composition of the invention, mention can be made of silicone compounds and polyacrylate compounds.

The antioxidant additive generally allows delayed degradation of the lubricant composition in use. Antioxidant additives notably act as radical inhibitors or hydroperoxide scavengers.

The antioxidant additives used in the invention are selected from among phenolic antioxidants.

Phenolic antioxidant additives can be selected in particular from among sterically hindered phenols, sterically hindered phenol esters, and sterically hindered phenols comprising a thioether bridge. Preferably, the sterically hindered phenols are selected from among compounds comprising a phenol group in which at least one vicinal carbon of the carbon carrying the alcohol function is substituted by at least one $C_1$-$C_{10}$ alkyl group, preferably $C_1$-$C_6$ alkyl group, preferably $C_4$ alkyl group, preferably by the tert-butyl group.

In one preferred embodiment, the lubricant composition used in the invention comprises, as additives, at least one additive selected from among anti-wear additives, extreme-pressure additives, anticorrosion additives, metal-deactivators and mixtures thereof.

In one preferred embodiment, the lubricant composition of the present invention can also comprise at least one additional polymer improving the viscosity index. As examples of additional polymer improving the viscosity index, mention can be made of polymer esters, hydrogenated or non-hydrogenated homopolymers or copolymers of styrene, butadiene and isoprene, polymethacrylates (PMAs).

In one embodiment of the invention, the lubricant composition comprises at least 0.01 weight % relative to the total weight of the lubricant composition, of at least one additive selected from among:

- anti-wear additives selected from among triaryl thiophosphates, carbamates and thiocarbamates;
- extreme-pressure additives selected from among ashless phosphorus or sulfur-phosphorus additives, phosphorothionates, phosphonates, dithiophosphates and thiophosphates;
- metal-deactivators selected from among tolutriazole, derivatives of tolutriazole or dimercaptothiadiazoles;
- antioxidants selected from among phenolic antioxidants;

anti-foam additives selected from among silicone compounds and polyacrylate compounds;

and mixtures thereof.

In one embodiment of the invention, the lubricant composition comprises at least 0.01 weight %, relative to the total weight of the lubricant composition, of at least one additive selected from among:

anti-wear additives selected from among triaryl thiophosphates, carbamates and thiocarbamates;

extreme-pressure additives selected from among ashless phosphorus or sulfur-phosphorus additives, phosphorothionates, phosphonates, dithiophosphates and thiophosphates;

metal-deactivators selected from among tolutriazole, derivatives of tolutriazole or dimercaptothiadiazoles, and mixtures thereof.

In one embodiment of the invention, the lubricant composition comprises from 0.01 to 3 weight %, relative to the total weight of the lubricant composition, of at least one additive selected from among:

anti-wear additives selected from among triaryl thiophosphates, carbamates and thiocarbamates;

extreme-pressure additives selected from among ashless phosphorus or sulfur-phosphorus additives, phosphorothionates, phosphonates, dithiophosphates and thiophosphates;

metal-deactivators selected from among tolutriazole, derivatives of tolutriazole or dimercaptothiadiazoles phenolic antioxidant additives and mixtures thereof.

In one embodiment of the invention, the lubricant composition comprises from 0.01 to 3 weight %, relative to the total weight of the lubricant composition, of at least one additive selected from among:

anti-wear additives selected from among triaryl thiophosphates, carbamates and thiocarbamates;

extreme-pressure additives selected from among ashless phosphorus or sulfur-phosphorus additives, phosphorothionates, phosphonates, dithiophosphates and thiophosphates;

metal-deactivators selected from among tolutriazole, derivatives of tolutriazole or dimercaptothiadiazoles, and mixtures thereof.

In one particular embodiment of the invention, the lubricant composition used in the invention, as additives, comprises:

from 0.05 to 1 weight % of an anti-wear additive of amine phosphate type; and from 0.05 to 1 weight % of a phenolic antioxidant additive, relative to the total weight of the lubricant composition.

In this embodiment, the amine phosphate is selected from among amine alkyl phosphates in which the alkyl group typically has 1 to 24 carbon atoms, preferably 1 to 16 carbon atoms, even 1 to 12 carbon atoms.

In this embodiment, the phenolic antioxidant is preferably selected from among sterically hindered phenols selected from among compounds comprising a phenol group in which at least one vicinal carbon of the carbon carrying the alcohol function is substituted by at least one $C_1$-$C_{10}$ alkyl group, preferably $C_1$-$C_6$ alkyl group, preferably $C_4$ alkyl group, preferably by the tert-butyl group. Preferably, the phenol is selected from among phenol compounds in which both vicinal carbons of the carbon carrying the alcohol function are substituted by at least one $C_1$-$C_{10}$ alkyl group, preferably $C_1$-$C_6$ alkyl group, preferably $C_4$ alkyl group, and preferably by the tert-butyl group, and in which another carbon is substituted by an alkyl-ester group.

Particularly advantageously, the composition of the invention is biodegradable, does not bioaccumulate in organisms and does not exhibit toxicity for the environment, more particularly the aquatic environment, and complies with the European Ecolabel and EAL American specifications. Additionally, the composition of the invention meets the requirements of different characteristic tests for gear lubricant compositions.

In one particular embodiment of the invention, the lubricant composition comprises:

from 97 to 99.99 weight % of hydrocarbon oil comprising at least 95 weight % of isoparaffins, less than 2 weight % of normal paraffins and a carbon content of biological origin equal to or higher than 90% relative to the total weight of the hydrocarbon oil; and from 0.01 to 3 weight % of phenolic antioxidant additive(s), relative to the total weight of the lubricant composition.

In one particular embodiment of the invention, the lubricant composition comprises:

from 97 to 99.9 weight % of hydrocarbon oil comprising at least 95 weight % of isoparaffins, less than 2 weight % of normal paraffins and a carbon content of biological origin equal to or higher than 90% relative to the total weight of the hydrocarbon oil; and from 0.1 to 3 weight % of extreme-pressure additive(s), relative to the total weight of the lubricant composition.

In one specific embodiment of the invention, the lubricant composition comprises:

from 97 to 99.9 weight %, relative to the total weight of the lubricant composition, of a hydrocarbon oil which comprises at least 98 weight % of isoparaffins, less than 2 weight % of normal paraffins and a carbon content of biological origin equal to or higher than 90% relative to the total weight of the hydrocarbon oil, said hydrocarbon oil having kinematic viscosity at 40° C. equal to or less than 5 cSt;

from 0.1 to 3 weight %, relative to the total weight of the lubricant composition, of at least one additive selected from among:

anti-wear additives selected from among triaryl thiophosphates, carbamates and thiocarbamates;

extreme-pressure additives selected from among ashless phosphorus or sulfur-phosphorus additives such as phosphates, phosphorothionates, phosphonates, dithiophosphates and thiophosphates such as dialkyl dithiophosphates;

metal-deactivators selected from among tolutriazole, derivatives of tolutriazole or dimercaptothiadiazoles;

antioxidants selected from among phenolic antioxidants;

and mixtures thereof.

In one specific embodiment of the invention, the lubricant composition comprises:

from 97 to 99.9 weight %, relative to the total weight of the lubricant composition, of a hydrocarbon oil which comprises at least 98 weight % of isoparaffins, less than 2 weight % of normal paraffins and a carbon content of biological origin equal to or higher than 90% relative to the total weight of the hydrocarbon oil, said hydrocarbon oil having kinematic viscosity at 40° C. equal to or less than 5 cSt;

from 0.1 to 3 weight %, relative to the total weight of the lubricant composition, of at least one additive selected from among:

anti-wear additives selected from among triaryl thiophosphates, carbamates and thiocarbamates;

extreme-pressure additives selected from among ashless phosphorus or sulfur-phosphorus additives such as phosphates, phosphorothionates, phosphonates, dithiophosphates and thiophosphates e.g. dialkyl dithiophosphates;

metal-deactivators selected from among tolutriazole, derivatives of tolutriazole or dimercaptothiadiazoles;

and mixtures thereof.

Preparation of the Lubricant Composition:

The lubricant composition used in the invention can be prepared with any method well known to those skilled in the art to formulate a lubricant composition, for example simply by mixing the ingredients preferably at ambient temperature.

In another embodiment, the hydrocarbon oil is previously heated before mixing with the additives.

Use of the Lubricant Composition:

The composition defined in the present invention is used as gear lubricant, in particular in the manufacturing and marine industry sectors, and for geared equipment likely to come into contact with the environment (water, air, etc.) or with individuals.

In one embodiment of the invention, the lubricant composition is used in industrial gearing, in particular industrial gearing on offshore installations. Among offshore installations, mention can be made of offshore wind turbines.

In one embodiment of the invention, the lubricant composition is used on gears intended to come into contact with water, preferably seawater.

In one embodiment of the invention, the lubricant composition is used at temperatures in the range of from 50 to 400° C., preferably in the range of from 100 to 300° C.

Lubricating Method:

The invention also concerns a gear lubricating method comprising applying a lubricant composition to gears, said lubricant composition comprising at least 97 weight %, relative to the total weight of the lubricant composition, of a hydrocarbon oil which has a weight content of isoparaffins in the range of 90 to 100%, a weight content of normal paraffins in the range of 0 to 10% and a carbon content of biological origin equal to or higher than 90% relative to the total weight of the hydrocarbon oil, and comprising at least 0.01 weight % relative to the total weight of the lubricant composition of at least one additive selected from among anti-wear additives, extreme-pressure additives, anticorrosion additives, metal-deactivators, anti-foam additives, antioxidant additives selected from among phenolic antioxidants, and mixtures thereof.

In one embodiment, the lubricant composition used in the lubricating method of the invention has one or more of the characteristics detailed above with regard to the use of the invention.

In one embodiment of the invention, the lubricant composition is used on industrial gears, in particular industrial gears on offshore installations. Among offshore installations, mention can be made of offshore wind turbines.

In one embodiment of the invention, the lubricant composition is used on gears intended to come into contact with seawater.

In one embodiment of the invention, the temperature of use of the lubricant composition is in the range of from 50 to 400° C., preferably from 100 to 300° C.

Gear:

The invention describes a gear coated with a lubricant composition comprising at least 97 weight %, relative to the total weight of the lubricant composition, of a hydrocarbon oil which has a weight content of isoparaffins in the range of 90 to 100%, a weight content of normal paraffins in the range of 0 to 10% and a carbon content of biological origin equal to or higher than 90% relative to the total weight of the hydrocarbon oil, and comprising at least 0.01 weight %, relative to the total weight of the lubricant composition, of at least one additive selected from among anti-wear additives, extreme-pressure additives, anticorrosion additives, metal-deactivators, anti-foam additives, antioxidant additives, and mixtures thereof.

In one embodiment, the lubricant composition used in the gear of the invention has one or more of the characteristics detailed above with regard to the lubricant composition of the invention and/or the use of the invention.

In one embodiment, the gear is an industrial gear, in particular an industrial gear for offshore installations. Among offshore installations, mention can be made of wind turbines.

In one embodiment of the invention, the gear is intended to come into contact with seawater.

The invention secondly concerns a gear lubricant composition comprising:

at least 97 weight % of at least one hydrocarbon oil which has a weight content of isoparaffins in the range of 90 to100%, a weight content of normal paraffins in the range of 0 to 10% and a carbon content of biological origin equal to or higher than 90% relative to the total weight of the hydrocarbon oil; and at least 0.01 weight % of at least one additive selected from among anti-wear additives, extreme-pressure additives, anticorrosion additives, metal-deactivators, anti-foam additives, antioxidants selected from among phenolic antioxidants, and mixtures thereof;

on the understanding that if said additive is an antioxidant, it is contained in an amount of at least 0.015 weight %, relative to the total weight of the lubricant composition.

Preferably, the gear lubricant composition of the invention has one or more of the characteristics detailed in the foregoing regarding the use of the invention, provided that if the composition comprises an antioxidant it is contained in an amount of at least 0.015 weight %, preferably at least 0.05 weight %, more preferably at least 0.1 weight %, relative to the total weight of the lubricant composition.

In one particular embodiment of the invention, the lubricant composition comprises:

from 97 to 99.95 weight %, preferably 97.5 to 99.9 weight %, more preferably 98 to 99.5 weight % of hydrocarbon oil, relative to the total weight of the lubricant composition; and from 0.05 to 3 weight %, preferably 0.1 to 2.5 weight %, more preferably 0.5 to 2 weight %, relative to the total weight of the lubricant composition, of at least one additive selected from among anti-wear additives, extreme-pressure additives, anticorrosion additives, metal-deactivators, anti-foam additives, antioxidants, and mixtures thereof, with the proviso that if the composition comprises an antioxidant, this is contained in an amount of at least 0.015 weight %, preferably at least 0.05 weight %, more preferably at least 0.1 weight %, relative to the total weight of the lubricant composition.

In one particular embodiment of the invention, the gear lubricant composition comprises:

from 97 to 99.9 weight %, relative to the total weight of the lubricant composition, of a hydrocarbon oil which comprises at least 98 weight % of isoparaffins, less than 2 weight % of normal paraffins and a carbon content of biological origin equal to or higher than 90% relative to the total weight of the hydrocarbon oil, said hydrocarbon oil having a kinematic viscosity at 40° C. equal to or less than 5 cSt;

from 0.1 to 3 weight %, relative to the total weight of the lubricant composition, of at least one additive selected from among:

anti-wear additives selected from among triaryl thiophosphates, carbamates and thiocarbamates;

extreme-pressure additives selected from among ashless phosphorus or sulfur-phosphorus additives such as phosphates, phosphorothionates, phosphonates, dithiophosphates and thiophosphates such as dialkyl dithiophosphates;

metal-deactivators selected from among tolutriazole, derivatives of tolutriazole or dimercaptothiadiazoles;

antioxidants selected from among phenolic antioxidants;

and mixtures thereof.

EXAMPLES

In the remainder of the present description, examples are given for the purpose of illustrating the present invention which are in no way intended to limit the scope thereof.

Example 1: Preparation of a Hydrocarbon Oil

A hydrocarbon oil is prepared following a method as described in the present invention. Table 1 groups together the physicochemical properties of the hydrocarbon oil.

TABLE 1

Physicochemical properties of the hydrocarbon oil of the invention (Oil 1).

| Characteristics | Oil 1 |
|---|---|
| Aromatics (ppm) | <20 |
| Sulfur (ppm) | 0.11 |
| % iso paraffins (w/w) | 96.2 |
| % n-paraffins (w/w) | 3.8 |
| % naphthenics (w/w) | 0 |
| C13 (iso) | 0 |
| C14 (iso) | 0 |
| C15 (iso) | 0 |
| C16 (iso) | 1.58 |
| C17 (iso) | 14.17 |
| C18 (iso) | 79.69 |
| C19 (iso) | 0.12 |
| C20 (iso) | 0.38 |
| C27 (iso) | 0.29 |

TABLE 1-continued

Physicochemical properties of the hydrocarbon oil of the invention (Oil 1).

| Characteristics | Oil 1 |
|---|---|
| Quantity of carbons of biological origin (%) | >98 |
| Initial boiling point (° C.) | 293.6 |
| 5% boiling point (° C.) | 296.7 |
| 50% boiling point (° C.) | 298.5 |
| 95% boiling point (° C.) | 305.3 |
| Final boiling point (° C.) | 324.1 |
| OECD biodegradability (28 days) (%) | 83 |
| Refractive index at 20° C. | 1.4394 |
| Density at 15° C. (kg/m3) | 787.2 |
| Flash point (° C.) | 149 |
| Kinematic viscosity at 40° C. (cSt) | 3.87 |
| Kinematic viscosity at 100° C. (cSt) | 1.48 |
| Vapour pressure at 20° C. (kPa) | <0.01 |
| Aniline point (° C.) | 99.5 |
| Pour point (° C.) | −45 |

The following standards and methods were used to measure the above properties:

Flash point: Cleveland Open Cup—ASTM D92

Density at 15° C.: ASTM D4052

Viscosity at 40° C.: ASTM D445

Aniline point: ASTM D611

Pour point: ASTM D97

Boiling point: ASTM D86

Biodegradability: OECD method 306

Refractive index at 20° C.: ASTM D 1218

Vapour pressure: calculated with methods well known to skilled persons.

Example 2: Evaluation of Oxidation Stability

The oxidation stability of several oils was tested in accordance with standard ASTM D2272 (revision 2014). It is a test known under the abbreviation RPVOT for Rotating Pressure Vessel Oxidation Test.

Several lubricant oils were tested:

Oil A: lubricant oil of ester type

Oil B: lubricant oil of naphthenic type

Oil C: commercial lubricant oil (fossil origin) of mineral oil type

Oil D: oil of polyalphaolefin type

Oil E: mineral oil

Oil 1: hydrocarbon oil of the invention defined in Example 1.

Table 2 groups together the characteristics of the comparative oils A to E.

TABLE 2

Characteristics of the tested oils

| | Method | Unit | Oil A | Oil B | Oil C | Oil D | Oil E |
|---|---|---|---|---|---|---|---|
| Appearance | Visual | — | Yellowish | Slightly yellowish | Transparent | Transparent | Transparent |
| Density at 15° C. | ASTM D4052 | $kg/m^3$ | 879.1 | 871 | 844 | 797.8 | 820 |
| Flash point Cleveland Open Cup | ASTM D92 | ° C. | 179 | 112 | 140.5 | 161 | 158 |
| Kinematic viscosity at 40° C. | ASTM D445 | $mm^2/s$ | 4.72 | 3.60 | 4.30 | 5.04 | 7.12 |
| Kinematic viscosity at 100° C. | ASTM D445 | $mm^2/s$ | 7.80 | 1.30 | 1.38 | 1.68 | 2.17 |

TABLE 2-continued

| Characteristics of the tested oils | | | | | | | |
|---|---|---|---|---|---|---|---|
| | Method | Unit | Oil A | Oil B | Oil C | Oil D | Oil E |
| Sulfur content | ASTM D5453 | ppm | | 30 | <1 | | |
| Aniline point | ASTMD 611 | ° C. | 25 | 67 | 87 | 102.4 | 101 |
| Pour point | ASTM D97 | ° C. | −9 | −81 | −1 | −66 | −37.5 |
| Aromatic content | UV method | ppm | | n/a | n/a | 198 | 92 |
| Simulated distillation | ASTM D2887 | ° C. | | | | | |
| T5 | | | 353 | 221 | 241 | 221 | 277 |
| T95 | | | 358 | 351 | 331 | 351 | 406 |
| T95-T5 | | | 5 | 130 | 90 | 130 | 129 |
| Aromatic carbon content | FTIR* | % | | 5.15 | 0.90 | 0 | 0 |
| Paraffinic carbon content | FTIR* | % | | 42.18 | 56.73 | 86.43 | 72.17 |
| Naphthenic carbon content | FTIR* | % | | 52.67 | 42.37 | 13.57 | 27.83 |

*Fourier transform infrared spectrometry

For the test, the addition was made to the tested oils of 0.5 weight % of an antioxidant of butyl hydroxytoluene type (BHT). The results of the RPVOT oxidation stability test are given in Table 3 below.

TABLE 3

| RPVOT in minutes | | | | | | |
|---|---|---|---|---|---|---|
| | Oil A | Oil B | Oil C | Oil D | Oil E | Oil 1 |
| Minutes | 15 | 30 | 315 | 330 | 390 | 465 |

Table 3 clearly shows that the hydrocarbon oil defined in the present invention exhibits much better oxidation stability than the comparative oils which correspond to lubricant oils used in the prior art.

Having regard to this excellent oxidation stability, the hydrocarbon oil defined in the present invention can therefore be used with a very low content of additives, in particular antioxidant additives, even no antioxidant additives at all, for gear lubrication, in particular for gears intended to be used under oxidizing conditions such as in offshore installations.

The invention claimed is:

1. A method for lubricating a gear, the method comprising applying a lubricant composition onto gears, the lubricant composition comprising:

at least 97 weight %, relative to the total weight of the lubricant composition, of at least one hydrocarbon oil which has a weight content of isoparaffins ranging from 95 to 100%, a weight content of normal paraffins ranging from 0 to 5% and a carbon content of biological origin equal to or higher than 90% relative to the total weight of the hydrocarbon oil, wherein the hydrocarbon oil has a distillation range ranging from 230 to 340° C., measured according to standard ASTM D86, wherein the hydrocarbon oil has a weight content of aromatic compounds equal to or less than 100 ppm, relative to the total weight of the hydrocarbon oil; and at least 0.01 weight %, relative to the total weight of the lubricant composition, of at least one additive selected from among anti-wear additives, extreme-pressure additives, anticorrosion additives, metal-deactivators, anti-foam additives, antioxidant additives selected from among phenolic antioxidants, and mixtures thereof.

2. The method according to claim 1, wherein the composition comprises:

from 97 to 99.95 weight % of hydrocarbon oil relative to the total weight of the lubricant composition; and from 0.05 to 3 weight %, relative to the total weight of the lubricant composition, of at least one additive selected from among anti-wear additives, extreme-pressure additives, anticorrosion additives, metal-deactivators, anti-foam additives, antioxidants and mixtures thereof.

3. The method according to claim 1, wherein:

the anti-wear additives are selected from among triaryl thiophosphates, carbamates and thiocarbamates; and/or the extreme-pressure additives are selected from among ashless phosphorus or sulfur-phosphorus additives; and/or the anticorrosion additives are selected from among N-acyl sarcosine compounds; and/or the metal-deactivators are selected from among tolutriazole, derivatives of tolutriazole or dimercaptothiadiazoles; and/or the anti-foam additives are selected from among silicone compounds; and/or the antioxidant additives are selected from among phenolic antioxidants and mixtures thereof.

4. The method according to claim 1, wherein said at least one additive is a phenolic antioxidant.

5. The method according to claim 4, wherein the antioxidant is selected from among compounds comprising a phenol group in which at least one vicinal carbon of the carbon carrying the alcohol function is substituted by at least one $C_1$-$C_{10}$ alkyl group.

6. The method according to claim 1, wherein the composition comprises at least 0.01 weight %, relative to the total weight of the composition, of at least one additive selected from among:

anti-wear additives selected from among triaryl thiophosphates, carbamates and thiocarbamates;

extreme-pressure additives selected from among ashless phosphorus and sulfur-phosphorus additives;

metal-deactivators selected from among tolutriazole, derivatives of tolutriazole or dimercaptothiadiazoles; and mixtures thereof.

7. The method according to claim 1, wherein the hydrocarbon oil is selected from among non-cyclic isoparaffins having 14 to 18 carbon atoms.

8. The method according to claim 1, wherein the hydrocarbon oil comprises:

a carbon content of biological origin equal to or higher than 95%; and/or a weight content of naphthenic compounds equal to or lower than 1%, relative to the total weight of the hydrocarbon oil.

9. The method according to claim 1, wherein the hydrocarbon oil has:

a biodegradability at 28 days of at least 60%, measured according to standard OECD 306; and/or a flash point equal to or higher than 110° C. according to standard EN ISO 2719; and/or a kinematic viscosity at 40° C. equal to or less than 5 cSt.

10. The method according to claim 1, wherein the hydrocarbon oil has:

a distillation range ranging from 290° C. to 325° C., measured according to standard ASTM D86; and a kinematic viscosity at 40° C. equal to less than 5 cSt.

11. The method according to claim 1, wherein the hydrocarbon oil is obtained by a catalytic hydrogenation process at a temperature of from 80 to 180° C. and at a pressure of from 50 to 160 bar of a deoxygenated and/or isomerized feedstock of biological origin.

12. The method according to claim 1, wherein the composition comprises:

from 97 to 99.9 weight %, relative to the total weight of the lubricant composition, of a hydrocarbon oil which comprises at least 98 weight % of isoparaffins, less than 2 weight % of normal paraffins, and a carbon content of biological origin equal to or higher than 90% relative to the total weight of the hydrocarbon oil, said hydrocarbon oil having a kinematic viscosity at 40° C. equal to or less than 5 cSt;

from 0.1 to 3 weight %, relative to the total weight of the lubricant composition of at least one additive selected from among:

anti-wear additives selected from among triaryl thiophosphates, carbamates and thiocarbamates;

extreme-pressure additives selected from among ashless phosphorus or sulfur-phosphorus additives;

metal-deactivators selected from among tolutriazole, derivatives of tolutriazole or dimercaptothiadiazoles;

antioxidants selected from among phenolic antioxidants; and mixtures thereof.

13. The method according to claim 1, wherein the temperature of application of the composition ranges from 50 to 400° C.

14. A gear lubricant composition comprising:

at least 97 weight %, relative to the total weight of the lubricant composition, of a hydrocarbon oil which has a weight content of isoparaffins in the range of from 95 to 100%, a weight content of normal paraffins in the range of from 0 to 5%, and a carbon content of biological origin equal to or higher than 90% relative to the total weight of the hydrocarbon oil, wherein the hydrocarbon oil has a distillation range ranging from 230 to 340° C., measured according to standard ASTM D86, wherein the hydrocarbon oil has a weight content of aromatic compounds equal to or less than 100 ppm, relative to the total weight of the hydrocarbon oil; and at least 0.01 weight %, relative to the total weight of the lubricant composition, of at least one additive selected from among anti-wear additives, extreme-pressure additives, anticorrosion additives, metal-deactivators, anti-foam additives, phenolic antioxidant additives, and mixtures thereof, and with the proviso that if said additive is a phenolic antioxidant, then said phenolic antioxidant is contained in an amount of a least 0.015 weight % relative to the total weight of the lubricant composition.

15. The lubricant composition according to claim 14, comprising at least 0.1 weight %, relative to the total weight of the lubricant composition, of at least one additive selected from among anti-wear additives, extreme-pressure additives, anticorrosion additives, metal-deactivators, anti-foam additives, phenolic antioxidant additives, and mixtures thereof.

16. The composition according to claim 14, comprising one or more of the following features:

the anti-wear additives are selected from among triaryl thiophosphates, carbamates and thiocarbamates; and/or the extreme-pressure additives are selected from among ashless phosphorus or sulfur-phosphorus additives; and/or the anticorrosion additives are selected from among N-acyl sarcosine compounds; and/or the metal-deactivators are selected from among tolutriazole, derivatives of tolutriazole or dimercaptothiadiazoles; and/or the anti-foam additives are selected from among silicone compounds; and/or the antioxidant additives are selected from among phenolic antioxidants and mixtures thereof; and/or the at least one additive selected from among:

anti-wear additives selected from among triaryl thiophosphates, carbamates and thiocarbamates;

extreme-pressure additives selected from among ashless phosphorus and sulfur-phosphorus additives;

metal-deactivators selected from among tolutriazole, derivatives of tolutriazole or dimercaptothiadiazoles; and mixtures thereof; and/or the hydrocarbon oil is selected from among non-cyclic isoparaffins having 14 to 18 carbon atoms;

the hydrocarbon oil comprises:

a carbon content of biological origin equal to or higher than 95%; and/or a weight content of naphthenic compounds equal to or lower than 1%, relative to the total weight of the hydrocarbon oil; and/or the hydrocarbon oil has:

a biodegradability at 28 days of at least 60%, measured according to standard OECD 306; and/or a flash point equal to or higher than 110° C. according to standard EN ISO 2719; and/or a kinematic viscosity at 40° C. equal to or less than 5 cSt.

17. The composition according to claim 16, wherein the hydrocarbon oil has:

a distillation range ranging from 290° C. to 325° C., measured according to standard ASTM D86; and a kinematic viscosity at 40° C. equal to less than 5 cSt.

* * * * *